US007901030B2

(12) United States Patent
Miyata et al.

(10) Patent No.: US 7,901,030 B2
(45) Date of Patent: Mar. 8, 2011

(54) INKJET RECORDING APPARATUS

(75) Inventors: Kyosei Miyata, Hachioji (JP); Naoki Otomo, Otsuki (JP)

(73) Assignee: Konica Minolta Holdings, Inc., Tokyo (JP)

( * ) Notice: Subject to any disclaimer, the term of this patent is extended or adjusted under 35 U.S.C. 154(b) by 608 days.

(21) Appl. No.: 11/899,593

(22) Filed: Sep. 6, 2007

(65) Prior Publication Data

US 2008/0107461 A1 May 8, 2008

(30) Foreign Application Priority Data

Nov. 6, 2006 (JP) ..... 2006-301010

(51) Int. Cl.
*B41J 2/165* (2006.01)
*G03G 21/00* (2006.01)

(52) U.S. Cl. ..... 347/22; 347/103; 347/104; 399/343; 399/350; 399/351

(58) Field of Classification Search ..... 347/22, 347/101, 103–107; 399/343–360
See application file for complete search history.

(56) References Cited

U.S. PATENT DOCUMENTS

| | | | | |
|---|---|---|---|---|
| 4,640,608 | A * | 2/1987 | Higaya et al. | 399/102 |
| 5,526,028 | A * | 6/1996 | Rottman | 347/23 |
| 6,076,218 | A * | 6/2000 | Taniguchi et al. | 15/102 |
| 6,188,863 | B1 * | 2/2001 | Gross et al. | 399/316 |
| 7,036,905 | B2 * | 5/2006 | Nagai et al. | 347/22 |
| 7,114,610 | B2 * | 10/2006 | Behymer et al. | 198/497 |
| 7,516,837 | B2 * | 4/2009 | Teshima et al. | 198/495 |
| 7,588,309 | B2 * | 9/2009 | Nakashima | 347/22 |
| 7,673,986 | B2 * | 3/2010 | Nakashima | 347/104 |
| 2006/0238596 | A1 * | 10/2006 | Mitsuhashi et al. | 347/104 |

FOREIGN PATENT DOCUMENTS

| | | | |
|---|---|---|---|
| JP | 03-227648 | A | 10/1991 |
| JP | 04-031070 | A | 2/1992 |
| JP | 2006-198987 | A | 8/2006 |
| JP | 2006-225085 | A | 8/2006 |

OTHER PUBLICATIONS

Extended European Search Report dated Mar. 9, 2009, 8 pages, issued in counterpart European Application No. 07115358.9-2304 / 1918115.

* cited by examiner

*Primary Examiner* — Daniel Petkovsek
(74) *Attorney, Agent, or Firm* — Holtz, Holtz, Goodman & Chick, PC

(57) ABSTRACT

An inkjet recording apparatus, including: a conveyance device including an endless belt which conveys a recording medium placed on an exterior surface of the endless belt; a recording device which jets ink onto the recording medium conveyed by the conveyance device; and a cleaning device to clean the surface, including, a flexible sheet member mounted more downstream in a conveyance direction of the belt than a position where the recording device is mounted, and a top of the flexible sheet member comes into slidably contact with the surface, and an elastic supporting member mounted at a side of the flexible sheet member; wherein when the flexible sheet member bends due to running of the belt, the elastic supporting member comes into contact with the flexible sheet member, and the elastic supporting member pushes the flexible sheet member so that the flexible sheet member presses against the surface of the belt.

19 Claims, 5 Drawing Sheets

INKJET RECORDING APPARATUS

This application is based on Japanese Patent Application No. 2006-301,010 filed on Nov. 6, 2006 with the Japanese Patent Office, the entire content of which is hereby incorporated by reference.

FIELD OF THE INVENTION

This invention relates to an inkjet recording apparatus, particularly relates to an inkjet recording apparatus including a conveyance device for conveying a recording medium which is placed on the exterior surface of an endless belt, and also a cleaning device for cleaning the ink adhered on the conveyance device.

BACKGROUND OF THE INVENTION

Known is an inkjet recording apparatus for jetting ink onto a recording medium to record an image thereon while an endless belt conveys the recording medium. The recording medium is in close contact with an exterior surface of the endless belt by electrostatic absorption or an adhesive agent applied to the exterior surface of the endless belt.

In the case of conducting a recording operation by conveying a recording medium in the inkjet recording apparatus, there is a case that due to inferior conveyance of the recording medium, ink is jetted onto the belt, not onto the recording medium. Further, in the case of recording, what is known as a borderless image, whereby ink is jetted onto the area which is a little bit wider than the size of the recording medium, so that ink is also jetted onto the belt around the recording medium.

If the ink jetted onto the exterior surface of the endless belt is allowed to adhere onto the rear surface of the recording medium, it lowers the recorded image quality. Further, since the ink lowers the surface resistance of the belt, the problem occurs that the belt decreases a force to adhere the recording medium, and conveyance capability of the recording medium deteriorates. Thus, up to now, a cleaning device has been provided to remove the ink adhered on the endless belt.

With respect to the method for removing the ink adhered on the endless belt, known is a method of rasping off said ink by sliding on and rubbing the moving belt surface while conveying the belt by contact of an elastic plate member, such as a wiper blade, made of rubber or plastic. In order to stabilize the sliding and rubbing force, the elastic plate member is pressed against the exterior surface of the endless belt at a predetermined force.

When the plate member is used as a cleaning means, if the plate member is always in contact with the belt, the conveyance system tends to become deformed by the pressing force of the plate member, which tends to deteriorate the image quality. Further, since the plate member is always forced in a single direction, the plate member can be deformed, which deteriorates its cleaning capability.

In order to overcome the above problems, the thickness of the plate member may be increased, or alternatively the elasticity of the plate member may be increased, so that the plate member tends to straighten itself due to its inherent elastic force, but the pressing force becomes greater on the surface of the endless belt, resulting in an effect opposite the desired one.

Further, there is a case in which the belt is driven in a direction opposite a normal conveyance direction due to paper jams, and a case in which even when the normal recording operation is conducted, after the recording medium is conveyed for a predetermined distance, the belt is driven in the opposite direction to convey the recording medium for the predetermined distance. In addition, the normal conveyance direction means a recording direction. That is, when the belt is driven in the opposite direction, and if the plate member is always in contact with the surface of the belt, the plate member is forced to bend. Since the plate member has elasticity exhibiting a predetermined pressing force, the plate member receives an unreasonable load, which can result in damage to the plate member and the belt.

Due to this, in the conventional art, the plate member is controlled to not always be in contact with the surface of the belt, and is controlled to contact the surface of the belt only when the belt is to be cleaned.

For example, by providing a wiper to scratch and drop the ink adhered on the belt surface and an absorbing member to clean the residing ink droplets left on remaining tracks of the wiper edge on the belt so as to be capable of contacting with and separating from the belt, the wiper and the absorbing member are in contact with the belt only when a cleaning sequence is conducted after the jam is detected, which overcomes the problem in the case that the wiper and the absorbing member are always in contact with the belt, which is disclosed in Unexamined Japanese patent Application Publication No. 3-227,648. Further, by providing a wiper to scratch and drop the ink adhered on the belt surface and an absorbing member to clean the residing ink droplets left on tracks of the wiper edge on the belt so as to be capable of contacting with and separating from the belt, the wiper and the absorbing member are made to contact the belt only when the recording operation is not conducted, which overcomes the problem in the case that the wiper and the absorbing member are always in contact with the belt, which is disclosed in Unexamined Japanese patent Application Publication No. 4-31,070.

In the case when conducting belt cleaning by contacting a cleaning member with the belt only when conducting a cleaning sequence after having detected a jam as, disclosed in Unexamined Japanese Patent Application Publication No. 03-227,648, since belt cleaning is not executed during normal recording operation, the ink, which has adhered onto the belt during normal operation, such as when recording a borderless image onto the recording material, cannot be cleaned off at all.

On the other hand, in the case when conducting belt cleaning by contacting the cleaning member with the belt only during a non-recording period, as proposed in Unexamined Japanese Patent Application Publication No. 04-31,070, since belt cleaning is not executed during normal recording operation, in case when continuously recording images onto a long recording material, such as textile outputted from rolled original textile, cleaning is not executed for a long period of time. Thus, since the recording material is conveyed when the belt surface is dirty, it is hard to avoid staining of the recording medium. Further, in case when the non-recording operation period does not coincide with the necessary time period for cleaning, the belt surface cannot be cleaned. When a recording operation is stopped until a cleaning operation is completed, the image recording productivity is reduced.

Further when the cleaning member is mechanically contacted with and separated from the belt surface, if the belt is conveyed at a high velocity to raise the recording productivity, the number of contact-separating operation of the cleaning member against the belt per a unit-time becomes large. Thus, there is a problem that mechanical operation sound level of the contact-separating operation becomes high.

Further, since a plurality of cleaning members are contacted with and separated from the belt, the maintenance work for stably operating the cleaning device for a long time becomes complicated.

SUMMARY OF THE INVENTION

An object of the present invention is to provide an inkjet recording apparatus including a belt cleaning function, which is capable of stably cleaning a belt surface and rasping off ink adhered on the belt surface, by simple structure, even during recording operations, without mechanical contact with and separation from the belt surface.

The other problems to be solved by this invention will be described below.

The problems described above can be solved by the following embodiments.

The preferred embodiment of this inkjet recording apparatus, includes:

a conveyance device including an endless belt which conveys a recording medium placed on an exterior surface of the endless belt, a recording device which jets ink onto the recording medium conveyed by the conveyance device, to record an image, and a cleaning device to clean the exterior surface of the endless belt, including:

a flexible sheet member which is mounted more downstream in a conveyance direction of the endless belt than a position where the recording device is mounted, and a top surface of the flexible sheet member comes into slidably contact with the exterior surface of the endless belt, and an elastic supporting member which is mounted to contact the flexible sheet member, wherein when the flexible sheet member bends due to running of the endless belt, the elastic supporting member comes into contact with the flexible sheet member to support, and the elastic supporting member provides a pressing force against the flexible sheet member so that the flexible sheet member presses against the exterior surface of the endless belt.

PREFERABLE EMBODIMENTS OF THE INVENTION

Figure 1:
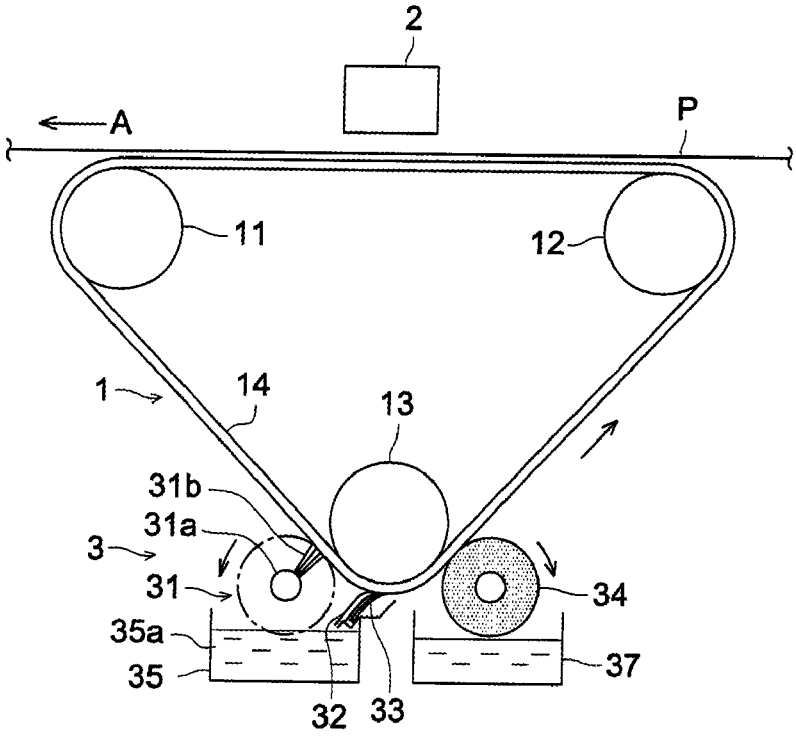
FIG. 1 illustrates a schematic side view of an inkjet recording apparatus.

An embodiment of the present invention will be described below while referring to the drawings.

FIG. 1 illustrates a schematic side view of an inkjet recording apparatus.

In FIG. 1, numeral 1 represents a belt type conveyance device in the present invention, in which drive roller 11 and driven roller 12 are parallel and provided at a predetermined interval, and weight roller 13 is set below and between drive roller 11 and driven roller 12. Endless belt 14 is entrained about drive roller 11, driven roller 12 and weight roller 13.

The exterior surface of endless belt 14 is arranged as a conveyance surface of the recording medium. In the normal recording state to record an image on recording medium P, as illustrated in FIG. 1, a sub-scanning motor (which is not shown) drives drive roller 11 counterclockwise at a predetermined velocity. Recording medium P, which is in close contact with the exterior surface of endless belt 14, is intermittently conveyed with a predetermined amount in the direction shown by arrow A, which is the sub-scanning direction.

In the present invention, endless belt 14 is driven in the direction shown by arrow A so that recording medium P is conveyed in the normal recording state.

With respect to the material of recording medium P, a recording material, which is normally used for inkjet recording, for example, paper, textile, plastic film and glass, may be used. Recording medium P may be a sheet cut to a predetermined size or a long sheet continuously unrolled from a spool, on which sheet is wound in a roll shape.

Numeral 2 represents a recording head provided above endless belt 14 entrained about drive roller 11 and driven roller 12. Recording head 2 is installed onto a carriage (which is not shown) and is able to reciprocally move along the main scanning direction (which is the depth direction of FIG. 1), which is perpendicular to arrow A. On the moving process along the main scanning direction, numerous nozzles formed on a nozzle surface are arranged to jet ink droplets of a specific color in response to image data onto recording medium P set below recording head 2. Based on this arrangement, recording head 2 is structured of an on-demand type inkjet head which forms a necessary image together with intermittent conveyance of recording medium P by the rotation of endless belt 14.

Further, recording head 2 is not limited to a shuttle type recording head, which reciprocally moves along the main scanning direction as described above. Recording head 2 may be a line type recording head, which is fixedly provided across the width of the recording medium formed into a long roll. In this case, endless belt 14 is driven so that recording medium P is continuously conveyed at a constant rate.

Numeral 3 represents a cleaning device, which is provided adjacent to weight roller 13, more downstream in the conveyance direction of endless belt 14 than the position where recording head 2. Cleaning device 3 includes brush roller 31, flexible sheet member 32, elastic supporting member 33 and water absorbing member 34.

Brush roller 31 serves as a cleaning device, and preferably equipped in the present invention. Said brush roller 31 is formed as a roller so that brush bristles 31*b* are planted along the circumferential surface of brush shaft 31*a*. The length of brush shaft 31*a* is formed so as to be the same or a little bit longer than the width of endless belt 14. The brush shaft 31*a* is bridged over the width direction of endless belt 14 and the edge of brush bristles 31 are always in contact with the exterior surface of endless belt 14.

In cases when endless belt 14 is in the recording state, brush roller 31 slides on and rubs against the exterior surface of endless belt 14 to remove any adhered ink, dust and foreign matter, such as dirt (hereinafter referred to as remaining ink).

In order to improve the removing effect, it is preferable that brush roller 31 is capable of reverse rotation (counterclockwise as shown in FIG. 1) against the conveyance direction of endless belt 14 by a driving device (which is not shown), to slide on and rub the exterior surface of the endless belt 14. The rotation rate of brush roller 31 is preferably set at 50-250 rpm.

With respect to the material of brush bristle 31*b*, any appropriate type of natural bristle and artificial bristle may be used. From the viewpoint of cost, durability and capability for removing remaining ink, etc., it is particularly preferable to use Nylon as the material for brush bristle 31*b*.

It is also preferable that the bristle diameter is set 0.05-0.3 mm.

With respect to the examples of planting brush bristle 31*b*, listed are methods 1-3:

method 1: planting brush bristle 31*b* over the full circumference of brush shaft 31*a* at a high density, method 2: arranging several rows of brush bristles 31*b* planted along the longitudinal direction of brush shaft 31*a* at a high density, and the rows to be separated from each other at a uniform interval around the circumference of brush shaft 31*a*, and method 3: spirally planting brush bristles 31*b* around the circumferential surface of brush shaft 31*a*.

In the three methods described above, it is preferable to use method 3 of spirally planting brush bristles 31*b* from the viewpoints of cost. Even though brush bristles 31*b* are planted with high density, any adverse effect to endless belt 14 is little, and it is possible to slide on and rub the exterior surface of endless belt 14 across its full width without unevenness by brush bristles 31*b*.

Figure 2:
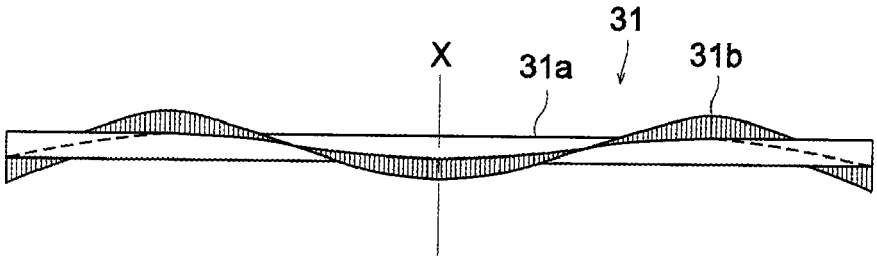
FIG. 2 illustrates a front view showing an example of a brush roller.

If brush bristles 31*b*, spirally planted in a single direction against the circumferential surface of brush shaft 31*a*, are used, shifting force may be generated which shifts endless belt 14 in one direction with respect to the width of endless belt 14 while endless belt 14 is driven, and thereby, there is the tendency to cause the shift of endless belt 14 in one direction. Thus in the case of spirally planting brush bristle 31*b*, as shown in FIG. 2, it is preferable that brush bristles 31*b* are planted so that the spiral shape is symmetrical at the center of the brush shaft length. Based on this arrangement, no shifting force to shift endless belt 14 in one direction of its width is generated, and the possibility of causing endless belt 14 to shift becomes extremely low.

As long as after recording medium P has been separated from the exterior surface of endless belt 14, the setting position of brush roller 31 may be determined anywhere downstream of a setting position of recording head 2 in the conveyance direction of endless belt 14. However, as shown in FIG. 1, it is preferable that the position of brush roller 31 is adjacent to the roller section, such as weight roller 13. Since in such position, the interior surface of endless belt 14 is supported by weight rollers 13, vibration and fluttering of endless belt 14 can be prevented. Further, since chatter vibration nor fluttering occur, the contact force of brush roller 31 against endless belt 14 can be stabilized to increase removable effect of remaining ink.

Below brush roller 31 serving as a washing device, water receiving section 35, in which washing water 35*a* is stored, is provided and a part of the ends of brush bristles 31*b* dip into washing water 35*a*. Thus, when brush roller 31 rotates, brush bristles 31*b* transfer washing water 35*a* out of water receiving section 35 so that washing water 35*a* washes the exterior surface of endless belt 14.

Figure 3:
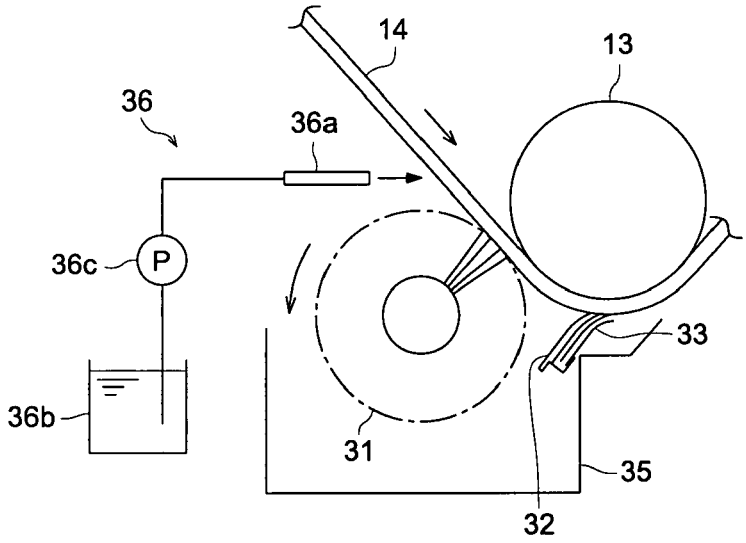
FIG. 3 illustrates a partial side view showing an example of a jetting device.

Further, instead of the structure for transferring washing water from water receiving section 35, washing water supplying device 36, which supplies washing water to the exterior surface of endless belt 14 by using spraying nozzle 36*a*, is provided adjacent to brush roller 31, as shown in FIG. 3. In FIG. 3, alpha-numeric designation 36*b* represents a storage tank for washing water, and alpha-numeric designation 36*c* represents a pump for jetting washing water in storage tank 36*b* from spraying nozzle 36*a*. In this case, water receiving section 35 stores any dripped washing water jetted from spraying nozzle 36*a*. The washing water may be supplied not only to the exterior surface of endless belt 14 but also directly onto brush roller 31.

Flexible sheet member 32 is provided more downstream in the conveyance direction of endless belt 14 than brush roller 31.

Further, elastic supporting member 33 serves as an elastic supporting member of the present invention, which is provided more downstream in the conveyance direction of endless belt 14 than flexible sheet member 32, and is adjacent to and parallel to flexible sheet member 32.

First Embodiment

Figure 4:
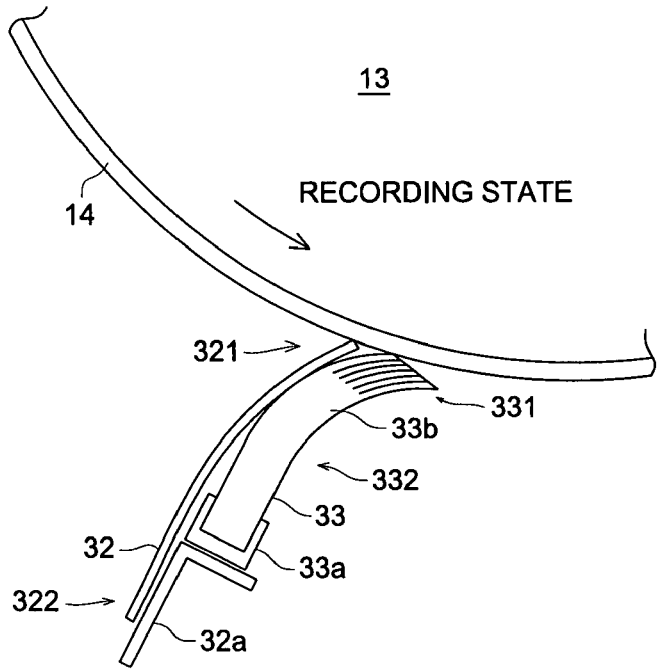
FIG. 4 illustrates a flexible sheet member and an elastic supporting member of a first embodiment, when the endless belt is rotating during the recording state.
Figure 5:
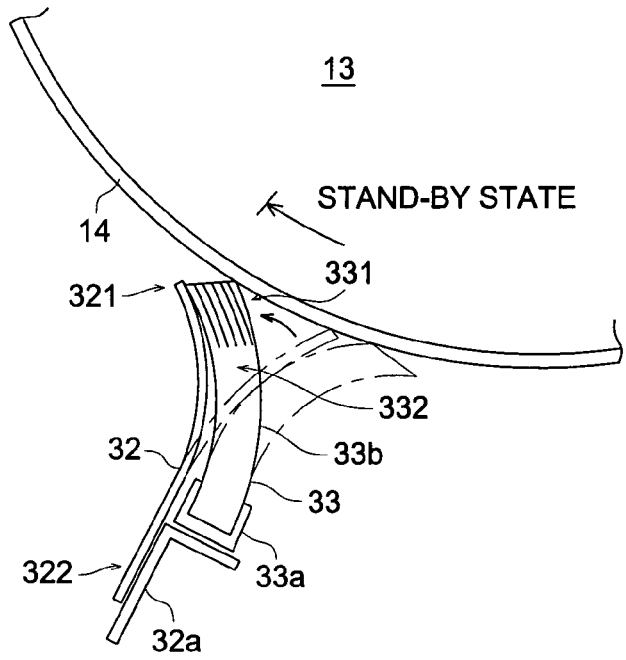
FIG. 5 illustrates the flexible sheet member and the elastic supporting member of the first embodiment, when the endless belt is during a stand-by state.
Figure 6:
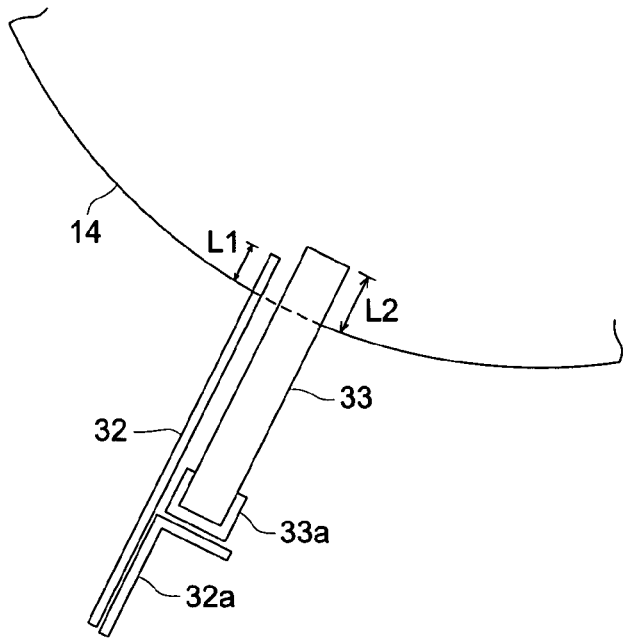
FIG. 6 illustrates nipping amounts of the flexible sheet member and the elastic supporting member.

A first embodiment relating to flexible sheet member 32 and elastic supporting member 33 will be further detailed while referring to FIGS. 4-6.

While endless belt 14 is driven, flexible sheet member 32 scrapes and removes any water droplets, including ink, adhered on the exterior surface of endless belt 14 passed through brush roller 31, the ink being diluted by washing water 35*a*.

Flexible sheet member 32 is formed of a single sheet material, to be the same as or slightly wider than the width of endless belt 14. Back end 322 of this flexible sheet member 32, which is positioned opposite the exterior surface of endless belt 14, is mounted on bracket 32*a* and positioned at a predetermined distance from the exterior surface of endless belt 14, whereby said flexible sheet member 32 is arranged across the full width of endless belt 14.

Since flexible sheet member 32 is mounted so that the distance from the bracket 32*a* to the exterior surface of endless belt 14 is arranged to be less than the free length of flexible sheet member 32 (the length extended from bracket 32*a*) as shown in FIG. 4. Accordingly, leading top edge 321 of flexible sheet member 32 bends in the same direction as the rotation of endless belt 14, and elastically contacts the exterior surface of endless belt 14.

The contact angle of flexible sheet member 32 against the exterior surface of endless belt 14 is preferably set in the range of −45°~+45° against the vertical direction so that the water droplets scraped by brush bristles 31*b* easily drop from back end 322.

Elastic supporting member 33 is provided so that a leading end 331 of the elastic supporting member 33 elastically comes into contact with the exterior surface of endless belt 14. When endless belt 14 is driven, leading end 331 elastically bends due to the rotation of endless belt 14. Intermediate portion 332 of elastic supporting member 33 convexly curves toward flexible sheet member 32 to come into contact with the concave surface of flexible sheet member 32. Accordingly, flexible sheet member 32 can be supported by elastic supporting member 33. That is, while using its elasticity, elastic supporting member 33 functions to apply contact-pressing force to the exterior surface of endless belt 14, through flexible sheet member 32.

Accordingly, said contact-pressing force is applied to the exterior surface of endless belt 14 by elastic supporting member 33. That is, since flexible sheet member 32 and elastic supporting member 33 work together, the contact-pressing force is generated, by which leading top edge 321 of flexible sheet member 32 can scrape off the remaining ink on the exterior surface of endless belt 14.

Since this structure, including flexible sheet member 32 and elastic supporting member 33, defers to a conventional rigid plate member, both flexible sheet member 32 and elastic supporting member 33 can easily bend while following not only the sheet conveyance movement but also the reverse movement of endless belt 14. That is, it is only necessary that flexible sheet member 32 and elastic supporting member 33 have flexibility to slidably contact the exterior surface of endless belt 14. As long as flexible sheet member 32 and elastic supporting member 33 are flexible enough to rub the surface of endless belt 14, they are not to be so elastic as to be rigid to scrape off any remaining ink by themselves, while elastically contacting the exterior surface of endless belt 14.

Due to this structure, though flexible sheet member 32 and elastic supporting member 33 are always in contact with the exterior surface of endless belt 14 during the sheet conveyance operation, no undesirable load is applied on rotating endless belt 14.

In order to satisfy the function of flexible sheet member 32 and elastic supporting member 33, the elasticity of elastic supporting member 33 was compared with that of flexible sheet member 32. As a result, it is found that each material can be preferably selected so that the elasticity of elastic supporting member 33 is greater than that of flexible sheet member 32.

Flexible sheet member 32 can be formed of a flexible rubber sheet or a resin sheet. In more detail, from the viewpoint of appropriate flexibility and inherent elastic force, a flexible sheet member is preferably formed of 0.05-0.3 mm polyethylene terephthalate (PET) sheet.

Elastic supporting member 33 can be formed of an appropriate material exhibiting greater elasticity compared to flexible sheet member 32.

In FIGS. 4-6, a straight strip brush, serving as elastic supporting member 33, is illustrated, on which brush bristles are planted across the width of the endless belt, which is a preferable example as elastic supporting member 33.

Said straight strip brush 33 is formed of a large number of brush bristles 33*b* planted on a straight strip brush base 33*a* arranged across the width of endless belt 14. The width of brush base 33*a* is at least as great as the width of endless belt 14, and brush base 33*a* is arranged along the width of endless belt 14.

Leading top edge 331 of brush bristles 33*b* is slightly bent and elastically contacts the exterior surface of endless belt 14, due to the inherent elasticity of brush bristles 33*b*. That is, straight strip brush 33 is mounted in such a way that the distance between brush base 33*a* and the exterior surface of endless belt 14 is less than the free length of brush bristles 33*b* (which is the length extending from brush base 33*a*), whereby straight strip brush 33 is bent in the conveyance direction of endless belt 14, and elastically contacts the exterior surface of endless belt 14.

In the first embodiment, since straight strip brush 33 is always in close contact with the exterior surface of endless belt 14, the ink droplets, remaining on the exterior surface of endless belt 14 cleaned by brush roller 31 and flexible sheet member 32, are diluted by washing water 35*a*, whereby the water droplets including remaining ink droplets are scraped and removed from the exterior surface of endless belt 14.

Additionally, each brush bristle 33*b* of straight strip brush 33 follows to rub any small irregularity on the exterior surface of endless belt 14, which increases the cleaning effect on endless belt 14.

The contact angle of straight strip brush 33 against the exterior surface of endless belt 14 is preferably set in a range of −45°~+45° against the vertical direction so that the water droplets scratched by brush bristle 32*b* easily drop from brush bristle 32*b*.

Natural bristle or artificial bristle can be used as a material for brush bristle. From the viewpoint of lower cost and high removable capability against ink, etc., Nylon is preferably used as a material for brush bristle 33*b*. The diameter of brush bristle 33*b* is preferably 0.05-0.3 mm, and the free length of brush bristle 33*b* is preferably 20-50 mm.

Nip forming amount L1 of flexible sheet member 32 against endless belt 14 and nip forming amount L2 of straight strip brush 33 against endless belt 14 (see FIG. 6), can be accordingly set at optimal values, respectively, based on the free lengths of flexible sheet member 32 and straight strip brush 33, as well as the attaching angle against endless belt 14. When endless belt 14 is rotating, as shown in FIG. 4, leading top edge 321 of flexible sheet member 32 is set so as to bend due to the rotation of endless belt 14, and leading top edge 331 of brush bristles 33*b* of straight strip brush 33, exhibiting elastic force, is also set so as to bend due to the rotation of endless belt 14.

When endless belt 14 is temporarily stopped for the conveyance, and then is rotated in the opposite direction (which is the clockwise direction in FIG. 5), brush bristles 33*b* of straight strip brush 33 are bent in the opposite direction due to the clockwise rotation of endless belt 14, and at the same time, flexible sheet member 32 is also bent in the opposite direction due to the clockwise rotation of endless belt 14, and further, leading top edge 331 of straight strip brush 33 pushes leading top edge 321 of flexible sheet member 32 to bend, whereby leading top edge 321 of flexible sheet member 32 is separated from the exterior surface of endless belt 14, that is, leading top edge 331 of straight strip brush 33 is supported between flexible sheet member 32 and the exterior surface of endless belt 14.

As an example, it is preferable that nip forming amount L1 of flexible sheet member 32 is set to be 0.5-19.5 mm, while nip forming amount L2 of straight strip brush 33 is set to be 1-20 mm. In addition, L1<L2 is essential.

It is preferable that a supporting member to support endless belt 14 from the rear is provided on the interior surface of endless belt 14, opposite both flexible sheet member 32 and straight strip brush 33 (being the elastic supporting member). Since in such position, even though leading top edge 321 of flexible sheet member 32 and leading top edge 331 of elastic supporting member 33 are in elastic contact with endless belt 14, it is possible to prevent the exterior surface of endless belt 14 from separating from both flexible sheet member 32 and elastic supporting member 33. Accordingly, the contact force of both flexible sheet member 32 and elastic supporting member 33 against endless belt 14 can be stabilized, and removal of the water droplets on the exterior surface of endless belt 14 can be improved.

In the embodiment illustrated in FIG. 1, flexible sheet member 32 and elastic supporting member 33 are arranged at the place where weight roller 13 is bridged over endless belt 14. Weight roller 13 functions as a member to support the surface opposed to both flexible sheet member 32 and elastic supporting member 33. Thus, it is not necessary to provide a separate support member.

As illustrated in FIG. 1, flexible sheet member 32 and elastic supporting member 33 are set so that back end 322 of flexible sheet member 32 and the base of elastic supporting member 33 are positioned inside water receiving section 35 to receive water from brush roller 31. Thus, any water droplets, which have been removed and dropped by flexible sheet member 32 and elastic support member 33, can be stored in water receiving section 35.

Liquid absorbing member 34 is provided more downstream in the conveyance direction of endless belt 14, than elastic supporting member 33, and contacts the exterior surface of endless belt 14. Liquid absorbing member 33 is not a necessary element in this embodiment, however, since liquid absorbing member 34 can absorb the water droplets on the exterior surface of endless belt 14, which have not been removed by flexible sheet member 32 and elastic supporting member 33 from the exterior surface of endless belt 14, the cleaning effect can be improved.

The material of liquid absorbing member 34 is preferably formed by porous absorbing material. Concretely, sponge can be utilized as the porous absorbing material.

Liquid absorbing member 34 can be structured so as to be in sliding contact with the exterior surface of endless belt 14, without moving. However, in order not to give unnecessary deviation of the conveyance function of endless belt 14, as illustrated in FIG. 1, liquid absorbing member 34 is preferably structured as a roller, which is driven due to contact with endless belt 14. The rotation of liquid absorbing member 34 improves its durability.

Below liquid absorbing member 34, waste ink receiver 37 is provided to store the liquid droplets, which were absorbed and dropped from rotated liquid absorbing member 34.

Next, the operation of cleaning device 3, incorporating flexible sheet member 32 and straight strip brush 33 as the elastic supporting member, relating to the first embodiment, will be detailed.

In the case that conveyance device 1 starts operation by turning the apparatus power switch on, brush roller 31 rotates in the reverse direction against the conveyance direction of endless belt 14. Brush roller 31 starts wiping and sliding against the exterior surface of endless belt 14, and both flexible sheet member 32 and straight strip brush 33 wipe and slide against the exterior surface of endless belt 14, while both flexible sheet member 32 and straight strip brush 33 also bend in the conveyance direction based on the conveyance of endless belt 14.

The ink jetted from recording head 2 forms a predetermined image onto intermittently conveyed recording medium P, which is placed on the exterior surface of endless belt 14. When endless belt 14 is further conveyed, the exterior surface of endless belt 14, from which recording medium P has been separated, approaches the setting place of brush roller 31. Rotating brush roller 31 slides on and wipes the exterior surface of endless belt 14 and removes any remaining ink by washing water 35*a* applied by brush roller 31.

After brush roller 31 washes the exterior surface of the endless belt 14, some water droplets, including diluted ink, are adhered onto the exterior surface of endless belt 14, and some of the water droplets do not run off and reside on the surface of endless belt 14.

As endless belt 14 is further conveyed and passes through the setting place of flexible sheet member 32, the water droplets on the exterior surface of endless belt 14 are wiped and dropped by flexible sheet member 32, which is forced against the exterior surface of endless belt 14 by straight strip brush 33. Wiped and dropped water droplets are stored in water receiving section 35 after passing flexible sheet member 32.

Further, brush bristles 33*b* of straight strip brush 33 also contact the exterior surface of endless belt 14, so that all residual water droplets on the exterior surface of endless belt 14 are wiped and dropped by straight strip brush 33. The wiped water is received in water receiving section 35 through brush bristles 33*b*. A water replenishing section and a drain section are provided in water receiving section 35, neither of which is illustrated.

After passing through straight strip brush 33, even though water droplets exist on the exterior surface of endless belt 14, the water droplets are absorbed by liquid absorbing member 34, driven by endless belt 14, and completely removed from the exterior surface of endless belt 14. At this moment, since flexible sheet member 32 and straight strip brush 33 remove almost of the water droplets, the water droplets absorbed by the liquid absorbing member 34 is an extremely small amount. Thus the frequency of the exchange of liquid absorbing member 34 due to staining decreases very much.

Since brush roller 31, flexible sheet member 32 and liquid absorbing member 34 are normally in contact with the exterior surface of endless belt 14, the overall cleaning operation by cleaning device 3 is continuous while conveyance device 1 is in the recording state. Accordingly, even in a case that a borderless image is recorded under normal recording operation and any ink is adhered on the exterior surface of endless belt 14, cleaning can be conducted in the recording state. Thus, it is not necessary to pay attention to the stains on recording medium P.

At this time, brush roller 31 and straight strip brush 33 are in contact with the exterior surface of endless belt 14 due to the inherent elastic force of brush bristles 31*b* and 33*b*. Further, since flexible sheet member 32 has lower elasticity than straight strip brush 33, and liquid absorbing member 34 is driven by endless belt 14, even though endless belt 14 is conveyed at a high rate, vibration and fluttering of endless belt 14 do not occur, and no vibration causing bad interference with the image formation occurs. Yet further, even though brush roller 31 and straight strip brush 33 are arranged to always contact the exterior surface of endless belt 14 during the normal operation, contact resistance is extremely low so that no tracking deviation is caused on conveyance device 1.

In the cases of adjusting the position of recording medium P, due to paper jams or conducting maintenance operation, even though endless belt 14 is conveyed in a reversed direction, brush roller 31, flexible sheet member 32 and straight strip brush 33 can remain in a contact state with endless belt 14. Thus, no problem is expected.

Further, since flexible sheet member 32 and straight strip brush 33 are always in contact with the exterior surface of endless belt 14, it is not necessary to conduct a contact-withdrawal operation of cleaning device 3 against endless belt 14 for cleaning operations, there is no operation sound, the structure can be easily configured and the maintenance work is reduced.

Since flexible sheet member 32 and straight strip brush 33 are kept in contact with the exterior surface of endless belt 14 for a long time, there is a possibility that flexible sheet member 32 and straight strip brush 33 are deformed to curve toward one side. To overcome this problem, it is preferable that when the recording operation finishes, conveyance device 1 stops the rotation of endless belt 14 at once and rotates endless belt 14 for a predetermined distance in the reverse direction against the normal conveyance direction of recording medium P.

Based on this operation, since flexible sheet member 32 and straight strip brush 33 are bent as shown in FIG. 5, which is a reversing direction against the direction of the cleaning operation and rests in the stand-by mode, whereby straight strip brush 33 is held between flexible sheet member 32 and endless belt 14 so that the deformation of flexible sheet member 32 and brush bristle 33*b* of straight strip brush 33 into wavy bristle curved in one side can be prevented.

Specifically, when flexible sheet member 32, exhibiting lower elasticity, is used, it tends to deform. During the stand-by state of endless belt 14, the operation of conveyance device 1 as described above is extremely effective in preventing flexible sheet member 32 to be bent in only one direction by contact with endless belt 14.

Further, each flexible sheet member 32 and straight strip brush 33 can easily follow the rotational direction of endless belt 14, being either clockwise or counterclockwise, and tend to bend in either direction, endless belt 14 as well as flexible sheet member 32 and straight strip brush 33 are less likely to be damaged.

The operation of conveyance device 1 as described above is more preferable when the exterior surface of endless belt 14 exhibits some adherence to recording medium P when it is in close contact with the exterior surface for the conveyance. That is, while endless belt 14 is in the stand-by state, if flexible sheet member 32 continues to be in contact with the exterior surface of endless belt 14, flexible sheet member 32 tends to somewhat adhere to the exterior surface of endless belt 14. However, in such a stand-by state, if endless belt 14 is rotated in the opposite direction (being the clockwise direction) for the predetermined direction, leading top edge 321 of flexible sheet member 32 is separated from the exterior surface of endless belt 14. Accordingly, flexible sheet member 32 cannot adhere to the exterior surface of endless belt 14 under the stand-by state.

In the stand-by state, straight strip brush 33 is always in contact with the exterior surface of endless belt 14. Since straight strip brush 33 is not facially in contact with the exterior surface of endless belt 14, but each brush bristle 32*b* having a very small diameter is linearly in contact with the exterior belt surface, the adhesive force is so small that straight strip brush 33 can follow the counter-clockwise rotation when normal conveyance operation starts. Thus, if the exterior surface of the endless belt exhibits the adherence, straight strip brush 33, serving as an elastic supporting member, is preferably utilized.

In this case, the opposite direction conveyance distance depends to the free length of flexible sheet member 32 and straight strip brush 32, and is typically set at 10-100 mm.

"Stand-by" state means a fairly long deactivated condition such as when the recording apparatus is switched off, but can also mean a condition while the apparatus is in an active state, for example, when changing recording medium P, changing recording head 2, cleaning, maintenance work due to non-jetting of ink from a nozzle, changing ink, and paper jams.

Second Embodiment

Figure 7:
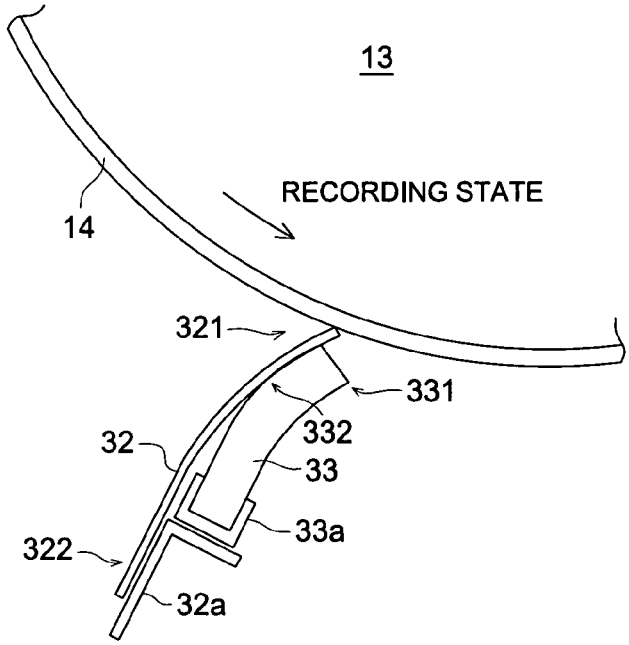
FIG. 7 illustrates a flexible sheet member and an elastic supporting member of the second embodiment, when the endless belt is rotating in the recording state.
Figure 8:
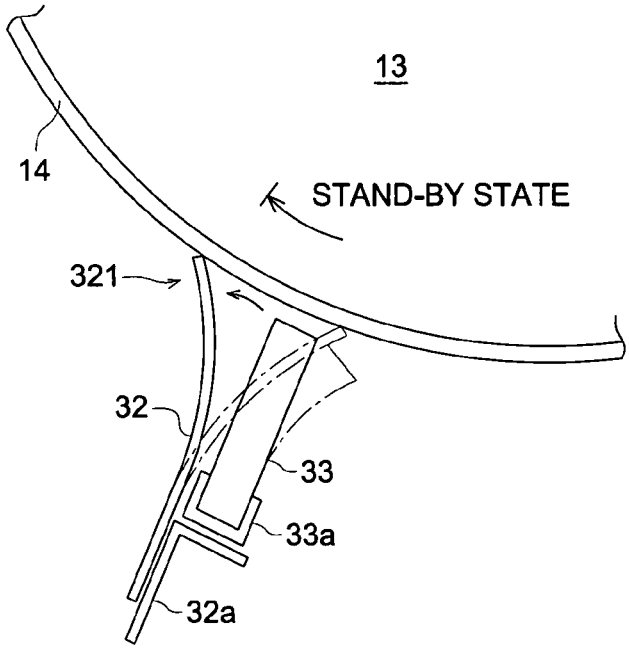
FIG. 8 illustrates the flexible sheet member and the elastic supporting member of the second embodiment, when the endless belt is in the stand-by state.

FIGS. 7 and 8 show flexible sheet member 32 and elastic supporting member 33 as a second embodiment.

In the second embodiment, leading top edge 331 of elastic supporting member 33 is provided not in contact with the exterior surface of endless belt 14, which differs to the first embodiment. FIG. 7 shows endless belt 14 is in the recording state, while FIG. 8 shows endless belt 14 is in the stand-by state.

Flexible sheet member 32 is provided to always be in contact with the exterior surface of endless belt 14, which is the same as the first embodiment, while elastic supporting member 33 exhibits shorter free length than that of the first embodiment so that it is provided never in contact with the exterior surface of endless belt 14.

Due to the above structure, when endless belt 14 rotates for normal sheet conveyance operation, leading top edge 321 of flexible sheet member 32 bends toward the rotating direction of endless belt 14 and wipes the exterior surface of endless belt 14. In that time, elastic supporting member 33 prevents flexible sheet member 32 from bending excessively, and intermediate section 332 elastically supports flexible sheet member 32, so that moderate elastic force is applied to flexible sheet member 32, which is the same as in the first embodiment.

Elastic supporting member 33 in the second embodiment can be represented by the straight strip brush the same as in the first embodiment, but since elastic supporting member 33 does not come into contact with the exterior surface of endless belt 14, elastic supporting member 33 can be formed of a sheet member, such as rubber and resin, as long as the degree of elasticity meets the condition described above.

The second embodiment can be used when the exterior surface of endless belt 14 exhibits no adhesion. The endless belt exhibiting no adhesion can be listed by a belt which electro-statistically attracts recording medium P.

While not illustrated, in each first and second embodiments structured of flexible sheet member 32 and elastic supporting member 33, by arranging a plurality of sets, structured of flexible sheet member 32 and elastic supporting member 33, along the conveyance path of endless belt 14, it is possible to improve the cleaning effects.

Figure 9:
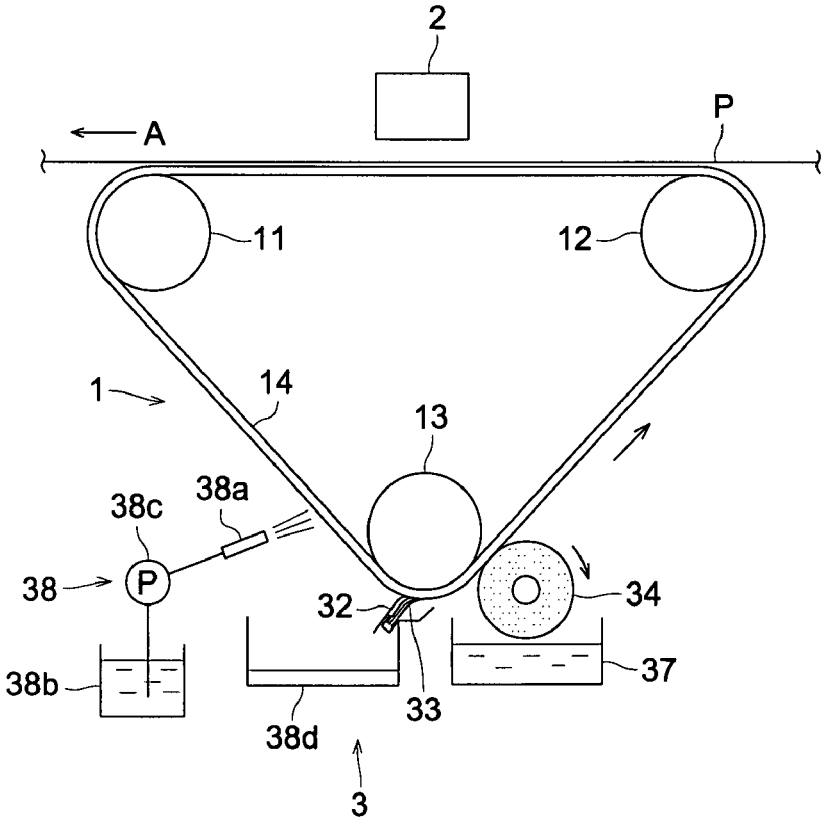
FIG. 9 illustrates another example incorporated in the inkjet recording apparatus.

FIG. 9 illustrates another embodiment of the inkjet recording apparatus. Since, the same symbols used in FIG. 1 have the same structure and function, their detailed description will be omitted.

In this embodiment, instead of brush roller 31 illustrated in FIG. 1, washing water jetting device 38 to spray washing water against the exterior surface of endless belt 14 is provided. In FIG. 9, alpha-numeric designation 38*a* represents a washing water jetting nozzle, alpha-numeric designation 38*b* represents a washing water storage tank, alpha-numeric designation 38*c* represents a pump for feeding the washing water from storage tank 38*b* through jetting nozzle 38*a*, and alpha-numeric designation 38*d* represents a waste water receiver.

Washing water jetting device 38 is arranged more downstream of the conveyance direction of endless belt 14 than the setting position of recording head 2, and washes any ink adhered on the exterior surface of endless belt 14, by jetting washing water.

In order to increase the ink removing effect, washing water jetting device 38 is preferably a high pressure spraying device which jets washing water with fairly high pressure.

A plurality of spraying nozzles 38*a* may be provided across the width of endless belt 14 to wash endless belt 14 across the total width direction at once. Or a single jetting nozzle 38*a* may be provided so as to be capable of moving across the width of endless belt 14 to wash the total width of endless belt 14 in a reciprocal motion.

After the washing water, jetted from jetting nozzle, washes the ink remaining on the exterior surface of endless belt 14, the washing water and diluted ink are removed and stored in water receiver 38*d*.

Even in this structure, while conveyance device 1 is operated, the cleaning operation can be continued, and the same effect described above can be obtained.

In the respective embodiments described above, cleaning device 3 is provided adjacent to weight roller 13. Particularly when using a liquid, such as washing water, to conduct cleaning, when the washing water on the exterior surface of endless belt 14 can naturally drip, this structure is preferable. However, as long as the location of cleaning device 3 is more downstream in the conveyance direction of endless belt 14 than recording head 2, and as long as cleaning is conducted after recording medium P has been removed, the setting place of cleaning device 3 is not limited.

Figure 10:
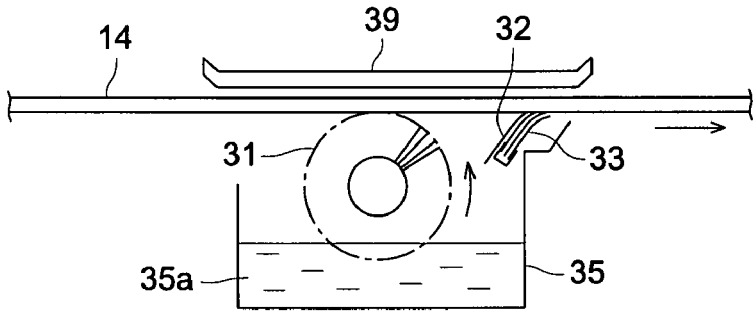
FIG. 10 illustrates a side view of another structure including a brush roller and an elastic supporting member.

Further, cleaning device 3 can also be provided in the place where endless belt 14 forms a flat surface. FIG. 10 illustrates an embodiment where brush roller 31, flexible sheet member 32 and elastic supporting member 33 are provided on the flat surface, which formed by endless belt 14. In this case, in order to assure a contact state between endless belt 14 and brush roller 31, flexible sheet member 32 and elastic supporting member 33, it is preferable that support member 39 to support the rear surface of endless belt 14 is preferably provided at a position opposed to brush roller 31, flexible sheet member 32 and elastic supporting member 33, while sandwiching endless belt 14.

In this embodiment, the same as FIG. 9, instead of the structure of brush roller 31, washing water jetting device 38 may be provided.

Based on the present invention, the inkjet recording apparatus can be provided, in which, while the endless belt does not vibrate even in the recording state, any ink adhered to the exterior surface of the endless belt is easily scraped off, and no contact-separating mechanism is used, being capable of cleaning the endless belt with a simple structure.

What is claimed is:

1. An inkjet recording apparatus, comprising:

a conveyance device including an endless belt for conveying a recording medium placed on an exterior surface of the endless belt;

a recording device for jetting ink to record an image onto the recording medium conveyed by the conveyance device; and a cleaning device for cleaning the exterior surface of the endless belt, wherein the cleaning device includes:

a flexible sheet member which is mounted at a position downstream, in a conveyance direction of the endless belt during a recording state, with respect to a position where the recording device is mounted, wherein the position at which the flexible sheet member is mounted is at a predetermined distance from the exterior surface of the endless belt, the distance being less than a free length of the flexible sheet member, such that the flexible sheet member is bent and such that a top of the flexible sheet member is in slidable contact with the exterior surface of the endless belt when the endless belt is driven during the recording state, wherein the flexible sheet member has a nip forming amount against the endless belt;

an elastic supporting member which is mounted at a side of the flexible sheet member such that, when the flexible sheet member is bent due to driving of the endless belt during the recording state, the elastic supporting member is in contact with the flexible sheet member to support the flexible sheet member and applies a pressing force against the flexible sheet member so that the flexible sheet member is pressed against the exterior surface of the endless belt, wherein the elastic supporting member has a nip forming amount against the endless belt;

wherein the flexible sheet member and the elastic support member are bendable in a direction opposite to the conveyance direction; and wherein, in a stand-by state in which the conveyance device does not convey the recording medium, the conveyance device drives the endless belt for a predetermined distance in the direction opposite to the conveyance direction, and stops the endless belt, thereby bending the flexible sheet member and the elastic support member in the direction opposite to the conveyance direction.

2. The inkjet recording apparatus of claim 1, wherein a top section of the elastic supporting member is separated from the exterior surface of the endless belt.

3. The inkjet recording apparatus of claim 1, wherein a top section of the elastic supporting member is in close contact with the exterior surface of the endless belt.

4. The inkjet recording apparatus of claim 1, wherein the endless belt is adapted to adhere to the recording medium.

5. The inkjet recording apparatus of claim 1, wherein, in the stand-by state, the conveyance device stops the endless belt after the flexible sheet member is separated from the exterior surface of the endless belt so that the elastic supporting member is sandwiched between the exterior surface of the endless belt and the flexible sheet member.

6. The inkjet recording apparatus of claim 1, wherein an elasticity of the elastic supporting member is greater than an elasticity of the flexible sheet member.

7. The inkjet recording apparatus of claim 1, wherein the flexible sheet member comprises a polyethylene terephthalate.

8. The inkjet recording apparatus of claim 1, wherein the elastic supporting member comprises a brush on which bristles are planted in a width direction of the endless belt.

9. The inkjet recording apparatus of claim 8, wherein the bristles comprise Nylon.

10. The inkjet recording apparatus of claim 1, wherein the cleaning device includes a washing device to wash the exterior surface of the endless belt, and wherein the washing device is mounted at a position downstream, in the conveyance direction of the endless belt during the recording state, with respect to the position where the recording device is mounted, and upstream, in the conveyance direction of the endless belt during the recording state, with respect to the position where the flexible sheet member is mounted.

11. The inkjet recording apparatus of claim 10, wherein the washing device is mounted so as to be in contact with the exterior surface of the endless belt, and comprises a brush roller for cleaning ink from the exterior surface of the endless belt.

12. The inkjet recording apparatus of claim 11, further comprising a driving device for rotating the brush roller in the direction opposite to the conveyance direction of the endless belt during the recording state.

13. The inkjet recording apparatus of claim 11, wherein a material of bristles of the brush roller comprises Nylon.

14. The inkjet recording apparatus of claim 11, wherein bristles of the brush roller are planted in a spiral shape on a shaft of the brush roller.

15. The inkjet recording apparatus of claim 14, wherein the bristles are planted so that right and left sides of the spiral shape are symmetrical about a center of a length of the shaft.

16. The inkjet recording apparatus of claim 10, wherein the washing device includes a liquid jetting device which jets washing water to clean ink from the exterior surface of the endless belt.

17. The inkjet recording apparatus of claim 1, wherein the cleaning device includes a liquid absorbing member for absorbing ink remaining on the endless belt, wherein the absorbing member is mounted to contact the endless belt at a position downstream, in the conveyance direction of the endless belt during the recording state, with respect to the elastic supporting member.

18. The inkjet recording apparatus of claim 17, wherein the liquid absorbing member comprises a porous material.

19. The inkjet recording apparatus of claim 17, wherein the liquid absorbing member comprises a roller which is rotated by the endless belt.

* * * * *